US009458685B2

(12) United States Patent
Huval et al.

(10) Patent No.: US 9,458,685 B2
(45) Date of Patent: Oct. 4, 2016

(54) APPARATUS AND METHOD FOR CONTROLLING A COMPLETION OPERATION

(75) Inventors: Sidney D. Huval, The Woodlands, TX (US); Michael J. Blackman, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 604 days.

(21) Appl. No.: 13/217,745

(22) Filed: Aug. 25, 2011

(65) Prior Publication Data

US 2013/0048275 A1 Feb. 28, 2013

(51) Int. Cl.

| | |
|---|---|
| ***E21B 23/00*** | (2006.01) |
| ***E21B 47/09*** | (2012.01) |
| ***E21B 43/16*** | (2006.01) |
| ***E21B 47/01*** | (2012.01) |

(52) U.S. Cl.

CPC ..... *E21B 23/00* (2013.01); *E21B 43/16* (2013.01); *E21B 47/01* (2013.01); *E21B 47/09* (2013.01)

(58) Field of Classification Search

CPC ..... E21B 43/00; E21B 43/26; E21B 23/00; E21B 47/01; E21B 43/16; E21B 47/09

USPC ..... 166/90.1, 311, 312

See application file for complete search history.

(56) References Cited

U.S. PATENT DOCUMENTS

| | | | | |
|---|---|---|---|---|
| 2007/0051517 | A1* | 3/2007 | Surjaatmadja et al. | 166/308.1 |
| 2007/0144740 | A1* | 6/2007 | Guo et al. | 166/254.2 |
| 2007/0246263 | A1 | 10/2007 | Reitsma | |
| 2007/0272407 | A1* | 11/2007 | Lehman | E21B 43/26 166/250.1 |
| 2010/0018703 | A1 | 1/2010 | Lovell et al. | |
| 2010/0078164 | A1 | 4/2010 | Bostick, III et al. | |
| 2010/0116550 | A1 | 5/2010 | Hutin et al. | |

OTHER PUBLICATIONS

International Search Report and Written Opinion dated Jan. 2, 2013 for International Application No. PCT/US2012/045683.

* cited by examiner

*Primary Examiner* — Giovanna C Wright
*Assistant Examiner* — Kristyn Hall
(74) *Attorney, Agent, or Firm* — Cantor Colburn LLP

(57) ABSTRACT

A method, computer-readable medium and apparatus for delivering a material to a downhole location in a formation is disclosed. A device is operated at a surface location to produce an action at the downhole location related to delivery of the material to the formation. A downhole parameter is measured at the downhole location, wherein the downhole parameter is affected by the operation of the device at the surface location. The downhole parameter is measured using a sensor proximate the downhole location. The measured downhole parameter is used to alter operation of the device at the surface location to deliver the material to the formation at the downhole location.

20 Claims, 5 Drawing Sheets

APPARATUS AND METHOD FOR CONTROLLING A COMPLETION OPERATION

BACKGROUND

Completion operations are often performed to prepare a borehole for petroleum production. Such operations can include, for example, fracturing operations ("fracking"), acid stimulation, sand control operations, gravel packing, etc. Typically, various operational parameters are measured during these completion operations for control purposes. Typically these parameters are measured using sensors located at a surface location and calculations are performed to determine related downhole parameters, such as downhole force, downhole torque, downhole fluid pressure, etc. Due to the large distances involved, the determined downhole parameters can be an inaccurate representation of the actual downhole parameters. Therefore, the present disclosure reveals an apparatus and method for obtaining parameters at a downhole location related to a completion operation and controlling the completion operation using the obtained downhole parameters.

BRIEF DESCRIPTION

In one aspect, a method of delivering a material to a downhole location in a formation is disclosed, the method including operating a device at a surface location to produce an action at the downhole location related to delivery of the material to the formation; measuring a parameter at the downhole location affected by the operation of the device at the surface location using a sensor proximate the downhole location; and using the measured downhole parameter to alter operation of the device at the surface location to deliver the material to the formation at the downhole location.

In another aspect, the present disclosure provides an apparatus for delivering a material to a formation at a downhole location of the formation, including: a surface device configured to perform an operation to produce an action at the downhole location related to delivery of the material to the formation; a downhole sensor proximate the downhole location configured to measure a downhole parameter related to the produced action; and a processor configured to alter an operation of the surface device using the measured downhole parameter.

In another aspect, the present disclosure provides a computer-readable medium having stored thereon instructions that when read by at least one processor enable the at least one processor to perform a method for fracturing a formation, the method including: measuring a downhole parameter affected by an operation at a surface device to deliver a material to a downhole location; and altering the operation of the surface device based on the downhole parameter.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
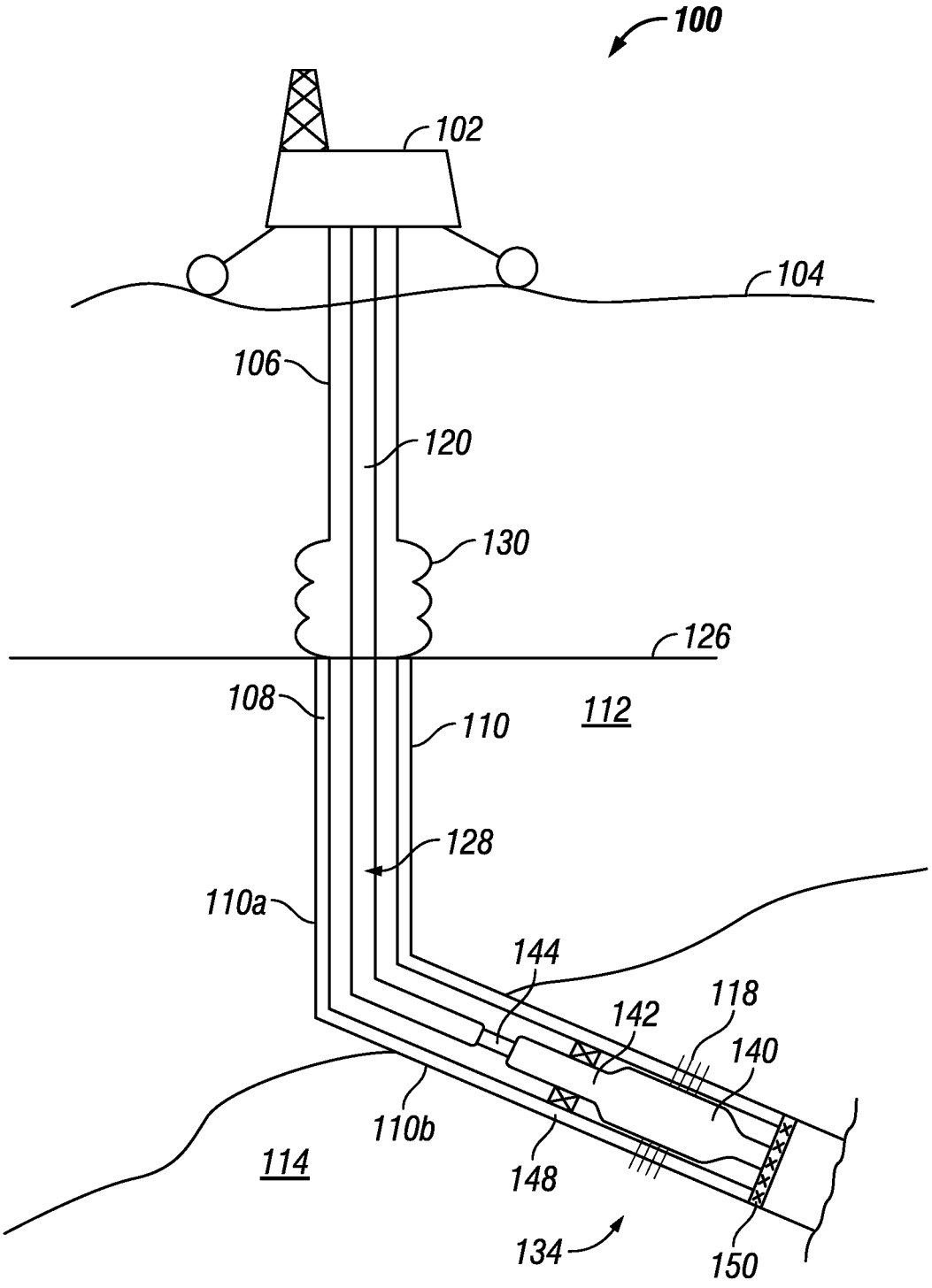
FIG. 1 shows an exemplary system for performing a completion operation according to one embodiment of the present disclosure.

FIG. 1 shows an exemplary completion system 100 for delivery of a material to a formation according to one embodiment of the present disclosure. The exemplary system 100 includes a rig platform 102 at a sea surface location 104 extending a tool string 120 downward past an ocean floor 126 into a wellbore 110 in an earth formation 112. A riser 106 extends from the rig platform 102 to a blow-out preventer 130 at the ocean floor 126. The tool string 120 runs from rig platform 102 along riser 106 through the blow-out preventer 130 and into the wellbore 110. In various embodiments, the tool string 120 can be a wired pipe and/or a drill pipe that is configured to convey various devices downhole for performing the fracturing operation. While the exemplary embodiment is shown with respect to an ocean rig platform 102, this is not meant as a limitation of the disclosure. The methods and apparatus disclosed herein are equally suitable for land operations.

The system of FIG. 1 is typically a completion system, but can be any system used in delivery of a material such as frac fluid, proppant, sand, acid, etc. to a downhole location. Delivery of the material typically includes pumping of the material into the formation under a determined pressure. While the system is discussed herein with particular reference to a fracturing operation, any aspect of a completion operation wherein material is delivered to a downhole location can be performed using the system and methods disclosed herein. Various exemplary operations that can be performed using the illustrated system of FIG. 1 therefore include fracturing operations ("fracking"), gravel packing operations, acid stimulation operations, sand control operations, pumping a fluid into the formation, and pumping a proppant into a formation, among others.

The exemplary wellbore 110 is shown to extend through the earth formation 112 and into a production zone or reservoir 114. The wellbore 110 shown in FIG. 1 includes a vertical section 110*a* and a substantially deviated section 110*b*. The wellbore 110 is lined with a casing 108 having a number of perforations 118. The tool string 120 is shown to include a portion that extends along the deviated section 110*b* of the wellbore 110. An exemplary downhole assembly, such as fracture tool assembly 134 ("frac assembly") is conveyed along the tool string 120 to a selected location that coincides with perforations 118. The tool string 120 defines an internal axial flowbore 128 along its length. During typical operations, various fluids and/or solids, such as fracturing fluid and/or proppant are sent downhole through the axial flowbore 128 and into the reservoir 114 via the frac assembly 134 and perforations 118. A proppant can be naturally occurring sand grains or man-made proppants such as resin-coated sand or high-strength ceramic materials like sintered bauxite.

In an exemplary embodiment, the frac assembly 134 may be isolated within the wellbore 110 by a pair of packer devices 148 and 150. Sump packer 150 isolates a lower portion of the tool string 120 at an end of the tool string 120. Although only one frac assembly 134 is shown along the tool string 120, multiple frac assemblies may be arranged along the tool string 120. The one or more frac assemblies can be located in the vertical section, deviated section or both the vertical and deviated sections of the wellbore. In various embodiments, the deviated section 110*b* of the wellbore is a substantially horizontal section.

The exemplary frac assembly 134 includes a screen 140 and an exemplary service tool 142 for controlling various operations of the frac assembly. The service tool 142 is configured to direct and control fluid flow paths, to maintain hydrostatic overbalance to the formation and to facilitate various fracturing processes and/or gravel packing operations, among others. A sensor sub 144 is coupled to a top end of the service tool 142 and to a downhole end of the tool string 120. The sensor sub 144 measures various downhole parameters associated with fracturing operations. These measured downhole parameters can be used to control operation of a surface device for performing the fracturing operation according to the methods disclosed herein. In one embodiment, the sensor sub 144 is a modular device. A detailed discussion of the sensor sub 144 is provided below with respect to FIG. 3.

Figure 2:
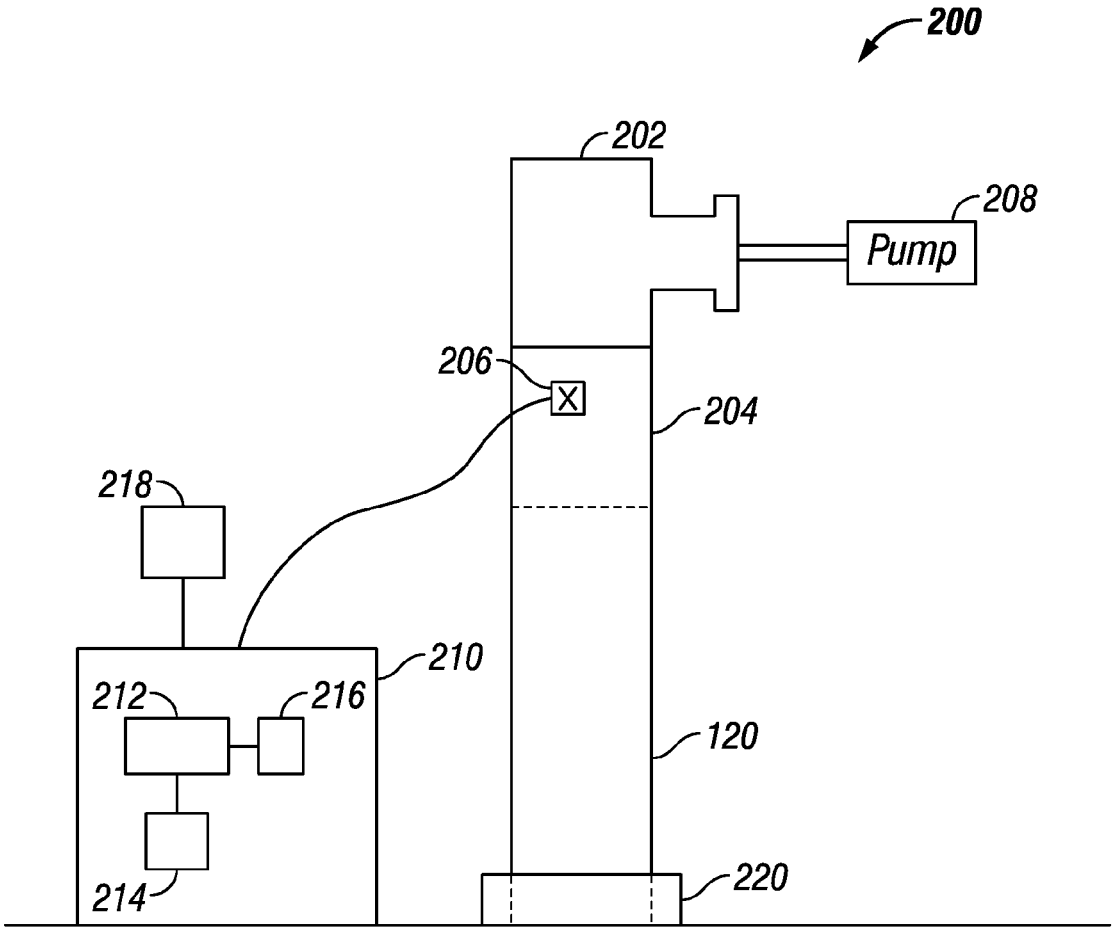
FIG. 2 shows a detailed view of various surface devices of the exemplary system of FIG. 1.

FIG. 2 shows a detailed view of various surface devices of the exemplary system of FIG. 1. A top end of tool string 120 is shown. A force application device 220 is coupled to the top end of the tool string 120 and can be used to apply a downward (or upward) force on the tool string, for example. In typical fracking operations, a downward force is applied to prevent upward motion of the tool string. The top end of the tool string further includes an interface sub 204 and a head 202 known as a "frac head." The frac head is configured for delivery of fracturing fluid and various proppants downhole. One or more pumps 208 are used to pump material via the frac head 202 into the tool string 120 for delivery to a downhole location. The signal interface sub 204 provides an entry point 206 for various wires that provide signal communication between devices on the rig platform and various downhole devices. In one embodiment, the tool string is composed of wired pipe sections having built-in communication lines, and signals are sent over the wired pipe. In an alternate embodiment, signals are sent over communication cables disposed in the annulus of a tool string or an annulus of a casing and can enter the annulus via a side entry sub.

FIG. 2 further shows a control unit 210 at the rig platform. The control unit 210 typically includes a processor 212, one or more computer programs 214 that are accessible to the processor 212 for executing instructions contained in such programs to perform the methods disclosed herein, and a storage device 216, such as a solid-state memory, tape or hard disc for storing the determining mass and other data obtained at the processor 212. Control unit 210 can store data to the memory storage device 216 or send data to a display 218. In one aspect of a fracking operation, the control unit 210 receives signals from the sensor sub 144 and, in response, sends signals to various surface devices, such as the force application device 220, and/or to the service tool 142 to control the operation at the surface.

Figure 3:
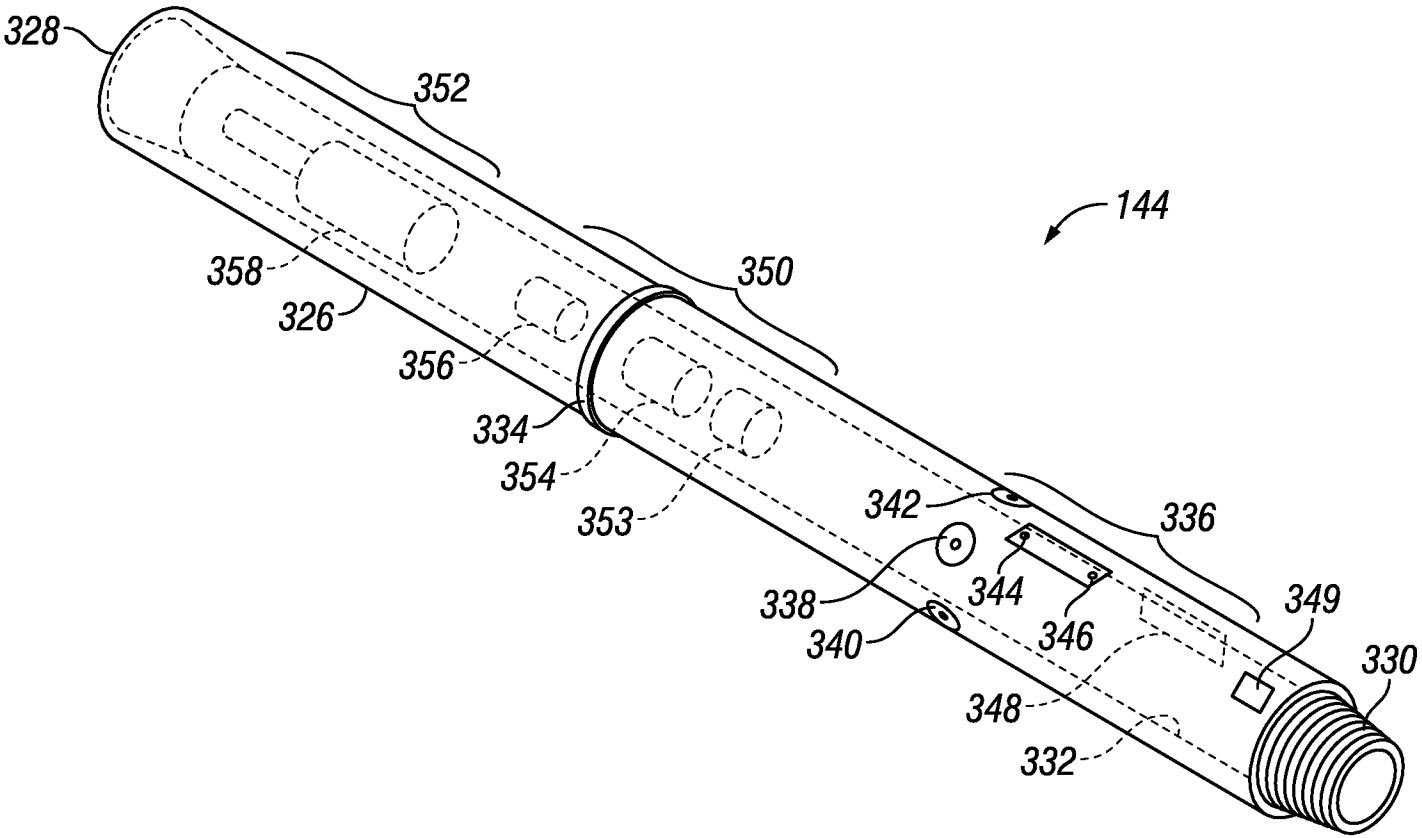
FIG. 3 shows a detailed view of an exemplary sensor sub used in a completion operation in one embodiment of the present disclosure.

FIG. 3 shows a detailed illustration of a sensor sub 144 of the present disclosure in one embodiment. The exemplary sensor sub 144 includes a generally cylindrical outer housing 326 having axial ends 328 and 330 that are configured to engage adjoining portions of the tool string 120 and the service tool 142, respectively. The housing 326 defines a flowbore 332 therethrough to permit the passage downhole of various fluid and solids. One or more wear pads 334 may be circumferentially secured about the sensor sub 144 to assist in protecting the sensor sub 144 from damage caused by borehole friction and engagement. The sensor sub 144 includes a sensor section 336 having a plurality of sensors mounted thereon. In the exemplary sensor sub 144 shown, the sensor section 336 includes a force sensor 338 that is capable of determining the amount of force exerted by the tool string 120 upon the service tool 142 and a torque gauge 340 that is capable of measuring torque exerted upon the service tool 142 by rotation of the tool string 120. Additionally, the sensor section 336 includes an angular bending gauge 342, which is capable of measuring angular deflection or bending forces within the tool string 120. Additionally, the sensor section 336 includes an annulus pressure gauge 344, which measures the fluid pressure within the annulus created between the housing 326 and the wellbore 110. A bore pressure gauge 346 measures the fluid pressure within the bore 332 of the sensor sub 144. An accelerometer 348 is illustrated as well that is operable to determine acceleration of the service tool 142 in an axial, lateral or angular direction. A temperature measurement device 349 can be used to obtain downhole temperatures. The exemplary sensor sub 144 can further include assemblies useful in orienting the tool with respect to the surrounding formation, for example, gamma count devices and directional sensors. Through each of the above described sensors, the sensor section 336 obtains and generates data relating to a fracking operation.

The sensor sub 144 also includes a processing section 350. The processing section 350 is configured to receive, among other things, signals concerning the operating conditions of the various completion operations as sensed by the various sensors of sensor section 336, such as downhole weight, downhole torque, downhole temperature, downhole pressure, for example. The processing section 350 typically includes a downhole processor 353 and storage medium 354 which are operably interconnected with the sensor section 336 to store data obtained from the sensor section 336. The downhole processor 353 includes one or more microprocessor-based circuits to process measurements made by the sensors in the sensor sub downhole during fracking operations. In one embodiment, the processing section 350 stores the received signals downhole at the storage medium 354. Upon return of the frac assembly to a surface location, the stored signals can be retrieved from the processing section 350 for processing to obtain information useful in future completion operations.

The processor section 350 also includes a data transmitter, schematically depicted at 356, for transmitting encoded data signals using various transmission means known in the art for transmitting such data to a surface location, such as electromagnetic transmission via wired pipe, fiber optic cable, etc. Therefore, in another embodiment, the signals received at the processing section 350 during a completion operation can be transmitted to the control unit 210 for processing in order to control the current completion operation. For example, the force application device 220 can be controlled to increase or decrease a downward force on the tool string based on a measurement of force obtained at the sensor sub 144. In addition, signals can be processed either at the downhole processor 353, the surface processor 212 or a combination of downhole processor and surface processor.

The sensor sub 144 further includes a power section 352. The power section 352 houses a power source 358 for operation of the components within the processor section 350 and the sensor section 336. In an exemplary embodiment, the power source 358 is one or more batteries. In another embodiment, the power source includes a "mud motor" mechanism that is actuated by the flow of a fluid downward through the tool string 120 and through the bore 332 of the sensor sub 144. Such mechanisms utilize a turbine that is rotated by a flow of fluid, such as frac fluid, to generate electrical power.

While the operable electrical interconnections for each of the sensor sub is not illustrated in FIG. 3, such are well known to those of skill in the art and, thus, are not described in detail herein. In an exemplary embodiment, the sensor sub 144 comprises portions of a CoPilot™ tool, which is available commercially from the INTEQ division of Baker Hughes, Incorporated, Houston, Tex., the assignee of the present disclosure.

Figure 4:
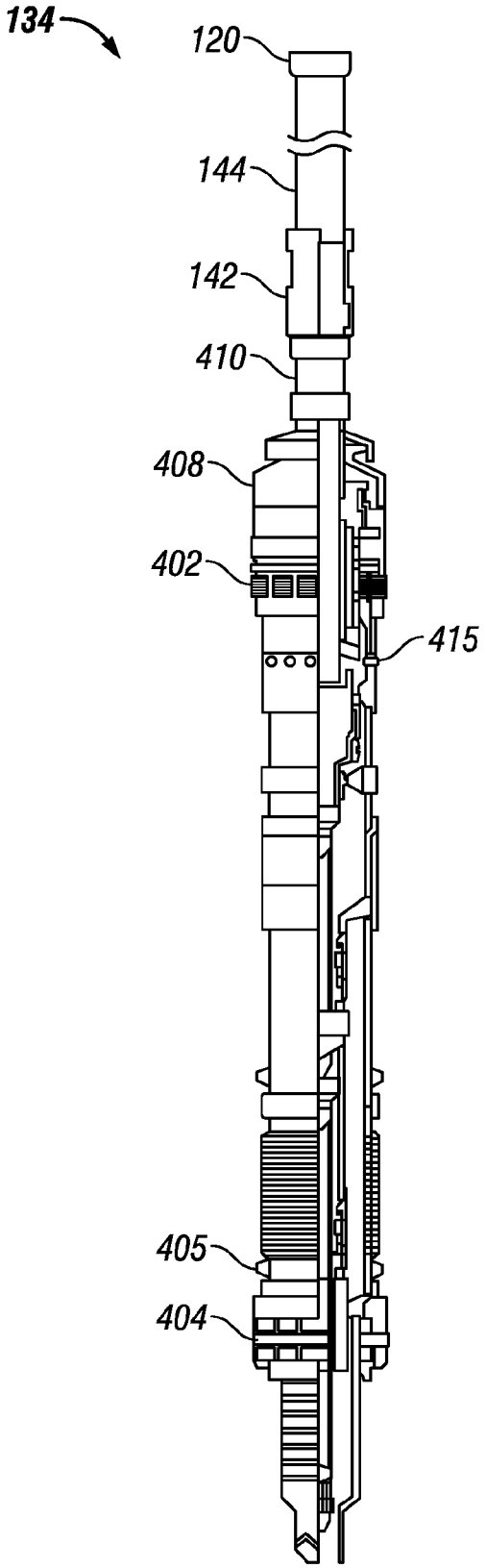
FIG. 4 shows a detailed view of an exemplary frac assembly attachable to a tool string for performing a frac operation at a downhole location in one aspect of the present disclosure.

FIG. 4 shows a detailed view of an exemplary frac assembly 134 attachable to a tool string for performing a frac operation at a downhole location according to one embodiment of the present disclosure. The frac assembly includes a top packer 402 and a bottom packer 404. A snap latch 405 is located at the bottom end of the frac assembly for coupling and decoupling the frac assembly 134 to and from the bottom packer 404. At the top end of the frac assembly is a crossover assembly 408 and pup joint 410 for insertion of the service tool 142. Sensor sub 144 sits atop the service tool 142 and is coupled to the tool string 120. The frac assembly 134 also has a frac extension section 415 for injecting frac fluid into the formation.

Various downhole parameters of the frac assembly 134 are measured at the sensor sub. Exemplary downhole parameters includes weight, torque, bending moment, internal pressure, external pressure, temperature, various dynamic parameters, and various parameters determined via formation evaluation measurements, such as gamma ray measurements. Exemplary downhole forces whose measurement can be used to control aspects of the fracking operation include a force related to inserting the snap latch into the bottom packer and indicating successful insertion; a force relating to a seal between the service tool 142 and the pup joint 410; a force between packer 402 and a wall of the wellbore; and a rotational force at the frac assembly. In addition, temperature measurements can be related to thermal expansion of downhole components, such as packers, or for maintain frac operation temperatures. Frac fluid pressure can be measured for pressure imbalances, etc. The operation of various surface devices can be altered based on the downhole measurements. For example, a force can be applied at surface device 220 for inserting the frac assembly into bottom packer 404; to maintain service tool in pup joint 410; and to maintain packer seals. Also, injection pressures can be modified based on downhole pressures and temperatures. Rotations of the tool string measured downhole can be equated to related rotations applied at a surface location.

Figure 5:
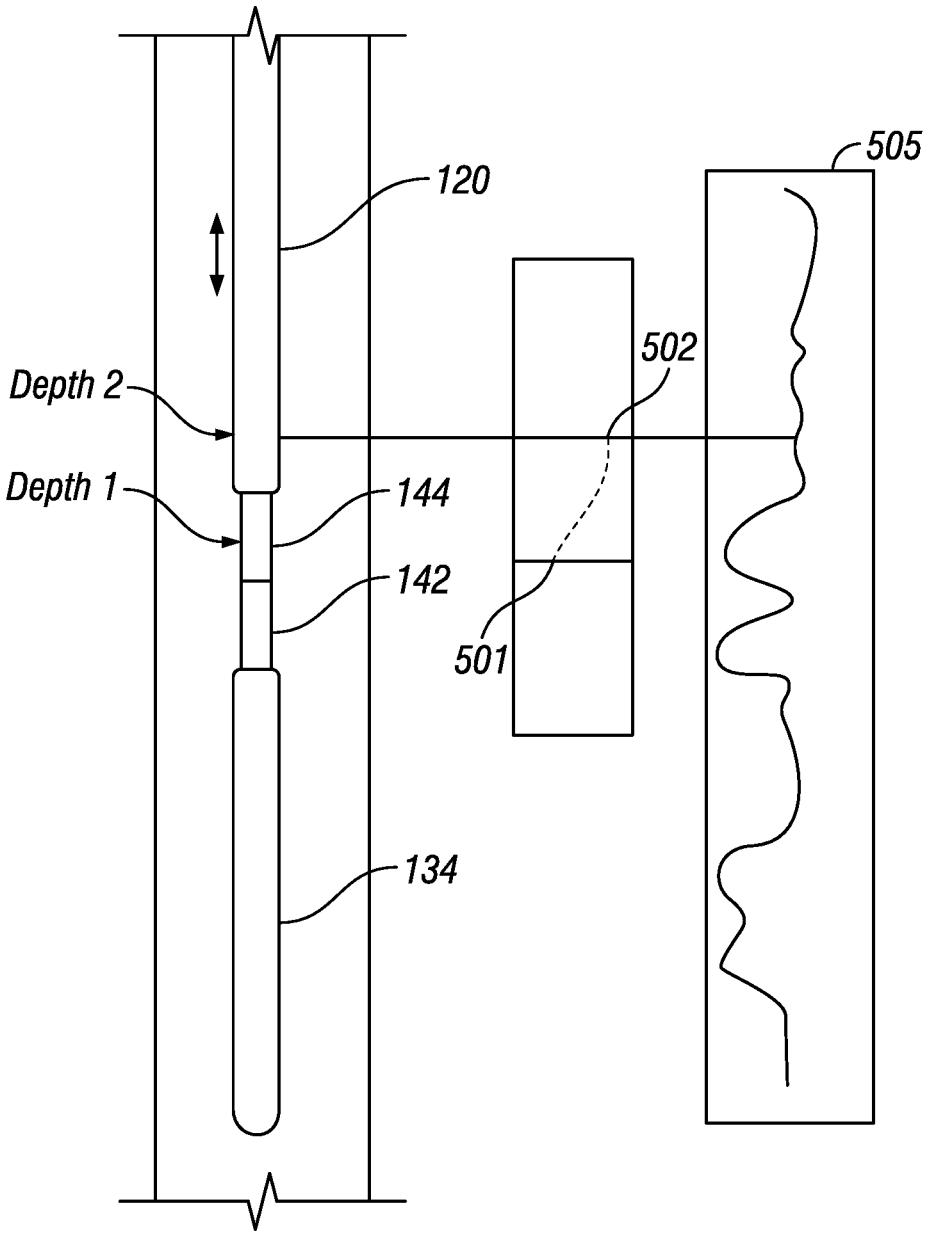
FIG. 5 illustrates a tool string having a device positionable within a borehole using obtained formation measurements in an exemplary operation of the present disclosure.

In another aspect, measurements obtained at the sensors sub are used to position the tool string at a selected depth. A sensor of the sensor sub 144, for example, a gamma ray sensor, obtains measurements of natural gamma ray emission from the surrounding formation. These measurements can be compared to a previously-obtained gamma ray log. FIG. 5 shows exemplary gamma ray measurements 501 and 502 for determining a sensor depth. A first gamma ray measurement 501 is obtained at the first depth of the downhole tool, which is generally a known location. The tool is moved to a second depth and a second gamma ray measurement 502 is obtained at the second depth. The first and second measurements can thus be compared to the previously obtained gamma ray log 505 to determine distance traveled. Although gamma ray sensors are used in the illustrative example, any sensors that can be used to obtain formation logs, such as resistivity, acoustic, etc can be used in alternative embodiments. In various embodiments the tool string 120 can be moved to a selected position during pumping of the material downhole.

Therefore, in one aspect, a method of delivering a material to a downhole location in a formation is disclosed, the method including operating a device at a surface location to produce an action at the downhole location related to delivery of the material to the formation; measuring a parameter at the downhole location affected by the operation of the device at the surface location using a sensor proximate the downhole location; and using the measured downhole parameter to alter operation of the device at the surface location to deliver the material to the formation at the downhole location. The device can be perform an operation that is related to at least one of: (i) a fracturing operation, (ii) a gravel packing operation; (iii) acid stimulation; (iv) a sand control operation; (v) pumping a fluid into the formation; and (vi) pumping a proppant into a formation. Also, the device can be used to perform running a completion device, setting a completion device, and pumping a material through a completion device. In one embodiment, the downhole parameter is communicated from the sensor to a surface processor via the tool string using at least one of: (a) wired pipe; (b) fiber optic cable; and (c) electromagnetic transmission. In another embodiment, the downhole parameter is stored at a downhole memory device. In another embodiment, the sensor is used to position a downhole device associated with the sensor in the borehole by obtaining a first measurement of a parameter of the formation at a first depth at the sensor; moving the sensor to a second depth; obtaining a second measurement of a parameter of the formation at the second depth; and comparing the obtained first and second formation measurements to a log of the surrounding formation to determine the second depth to position the sensor. The downhole location can be a location in a deviated section of the borehole. The measured downhole parameter can include at least one of: (i) weight; (ii) torque; (iii) bending moment; (iv) pressure; (v) temperature; (vi) a dynamic measurement; and (vii) a gamma ray measurement. The operation of the surface device can include at least one of: (i) applying a force on a tool string; (ii) applying a rotation to the tool string; and (iii) pumping the material into the tool string.

In another aspect, the present disclosure provides an apparatus for delivering a material to a formation at a downhole location of the formation, including: a surface device configured to perform an operation to produce an action at the downhole location related to delivery of the material to the formation; a downhole sensor proximate the downhole location configured to measure a downhole parameter related to the produced action; and a processor configured to alter an operation of the surface device using the measured downhole parameter. In various embodiments, the surface device can perform an operation related to at least one of: (i) a fracturing operation, (ii) a gravel packing operation; (iii) acid stimulation; (iv) a sand control operation; (v) pumping a fluid into the formation; and (vi)

pumping a proppant into a formation. In another embodiment, device is configured to perform at least one of: running a completion device in a borehole, setting a completion device in a borehole, and pumping the material through the completion device. In one embodiment, the processor is a surface processor configured to communicate with the downhole sensor via at least one of: (a) a wired pipe; (b) a fiber optic cable, and (c) an electromagnetic transmission device. In another embodiment, a downhole memory device can be used to store the measured downhole parameter. The downhole sensor can be configured to obtain a first measurement of a parameter of the formation at a first sensor depth and a second measurement of the parameter of the formation at a second sensor depth, and wherein the processor is further configured to determine a position of the second depth from a comparison of the first and second formation measurements to a log of the surrounding formation. The downhole location can be in a deviated section of the wellbore. In various embodiments, the downhole parameter is at least one of: (i) downhole weight; (ii) downhole torque; (iii) downhole bending moment; (iv) downhole pressure; (v) downhole temperature; (vi) a dynamic measurement; and (vii) a gamma ray measurement. The surface device typically performs an operation selected from at least one of: (i) applying a force on a tool string at the surface location; (ii) applying a rotation to the tool string at the surface location; and (iii) pumping the material into the tool string.

In another aspect, the present disclosure provides a computer-readable medium having stored thereon instructions that when read by at least one processor enable the at least one processor to perform a method for fracturing a formation, the method including: measuring a downhole parameter affected by an operation at a surface device to deliver a material to a downhole location; and altering the operation of the surface device based on the downhole parameter. The computer-readable medium of claim 19, further comprising at least one of: (i) a ROM, (ii) an EPROM, (iii) an EAROM, (iv) a flash memory, and (v) an optical disk.

As described above, embodiments may be in the form of computer-implemented processes and apparatuses for practicing those processes. In exemplary embodiments, the disclosure is embodied in computer program code. Embodiments include computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the disclosure. Embodiments include computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the disclosure. The technical effect of the executable instructions is to alter a parameter of a surface device operating a fracture assembly downhole.

While the disclosure has been described with reference to an exemplary embodiment or embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the claims. Also, in the drawings and the description, there have been disclosed exemplary embodiments of the disclosure and, although specific terms may have been employed, they are unless otherwise stated used in a generic and descriptive sense only and not for purposes of limitation, the scope of the disclosure therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of delivering a material to a downhole location in a formation, comprising:

operating a force application device at a surface location to apply a force at the surface location to a tool string extending from the surface location to the downhole location, wherein the applied force produces an action at an assembly at the downhole location during a frac operation or a completion operation;

measuring the force applied to the tool string by the force application device using a sensor located at the assembly at the downhole location;

using the measurement of the applied force to alter the force applied by the force application device, and using a pump to deliver material through the tool string to the formation.

2. The method of claim 1, further comprising operating the force application device to perform an operation related to at least one of: (i) a fracturing operation, (ii) a gravel packing operation; (iii) acid stimulation; and (iv) a sand control operation.

3. The method of claim 1, further comprising operating the force application device to perform at least one of: (i)running; and (ii) setting a completion device.

4. The method of claim 1, further comprising communicating the downhole parameter from the sensor to a surface processor via the tool string using at least one of: (a) wired pipe; (b) fiber optic cable; and (c) electromagnetic transmission.

5. The method of claim 1, further comprising storing the measurement of the applied force at a downhole memory device.

6. The method of claim 1, wherein the operation further comprising positioning a downhole device associated with the sensor in the borehole, the method further comprising:

obtaining a first measurement of a parameter of the formation at a first depth at the sensor;

moving the sensor to a second depth;

obtaining a second measurement of a parameter of the formation at the second depth; and comparing the obtained first and second formation measurements to a log of the surrounding formation to determine the second depth to position the sensor.

7. The method of claim 1, further comprising delivering the material to the downhole location in a deviated section of the borehole.

8. The method of claim 1, wherein the measured downhole parameter is at least one of: (i) weight; (ii) torque; and (iii) bending moment.

9. The method of claim 1, wherein operation of the surface force application device further comprises at least one of: (i) applying a force on the tool string; and (ii) applying a rotation to the tool string.

10. An apparatus for delivering a material to a formation at a downhole location of the formation, comprising:

a surface force application device configured to apply a force at a surface location to a tool string extending from the surface location to the downhole location, wherein the applied force produces an action at an assembly at the downhole location during a frac operation or a completion operation;

a downhole sensor proximate the downhole location configured to measure the force applied top the tool string by the force application device; and a processor configured to alter the force applied by the surface force application device using the measured force; and a pump configured to deliver the material through the tool string to the formation at the downhole location.

11. The apparatus of claim 10, wherein the surface force application device is configured to perform an operation related to at least one of: (i) a fracturing operation, (ii) a gravel packing operation; (iii) acid stimulation; and (iv) a sand control operation.

12. The apparatus of claim 10, wherein the force application device is further configured to perform at least one of: (i) running; and (ii) setting a completion device.

13. The apparatus of claim 10, wherein the processor is a surface processor configured to communicate with the downhole sensor via at least one of: (a) a wired pipe; (b) a fiber optic cable, and (c) an electromagnetic transmission device.

14. The apparatus of claim 10, further comprising a downhole memory device configured to store the measurement of the applied force.

15. The apparatus of claim 10, wherein the downhole sensor is further configured to obtain a first measurement of a parameter of the formation at a first sensor depth and a second measurement of the parameter of the formation at a second sensor depth, and wherein the processor is further configured to determine a position of the second depth from a comparison of the first and second formation measurements to a log of the surrounding formation.

16. The apparatus of claim 10, wherein the downhole location is in a deviated section of the wellbore.

17. The apparatus of claim 10, wherein the downhole parameter is at least one of: (i) downhole weight; (ii) downhole torque; and (iii) downhole bending moment.

18. The apparatus of claim 10, wherein the surface force application device is configured to perform an operation selected from at least one of: (i) applying a force on a tool string at the surface location; and (ii) applying a rotation to the tool string at the surface location.

19. A non-transitory computer-readable medium having stored thereon instructions that enable at least one processor to perform a method, the method comprising:

operating a force application device at a surface location to apply a force at the surface location to a tool string extending from the surface location to a downhole location, wherein the applied force produces an action at an assembly at the downhole location during a frac operation or a completion operation;

measuring the applied force using a sensor located at the assembly ; and altering the force applied by the surface force application device based on the downhole parameter; and operating a pump to deliver a material through the tool string to the formation at the downhole location.

20. The computer-readable medium of claim 19, further comprising at least one of: (i) a ROM, (ii) an EPROM, (iii) an EAROM, (iv) a flash memory, and (v) an optical disk.

* * * * *